US012790777B2

(12) United States Patent
Ustach et al.

(10) Patent No.: US 12,790,777 B2
(45) Date of Patent: Nov. 10, 2026

(54) OFFSET BOLLARD

(71) Applicant: McCue Corporation, Danvers, MA (US)

(72) Inventors: Thomas Ustach, Boston, MA (US); Matthew O'Brien, Gresham, OR (US)

(73) Assignee: McCue Corporation, Danvers, MA (US)

( * ) Notice: Subject to any disclaimer, the term of this patent is extended or adjusted under 35 U.S.C. 154(b) by 591 days.

(21) Appl. No.: 18/236,523

(22) Filed: Aug. 22, 2023

(65) Prior Publication Data

US 2024/0060254 A1 Feb. 22, 2024

Related U.S. Application Data

(60) Provisional application No. 63/399,821, filed on Aug. 22, 2022.

(51) Int. Cl.
*E01F 9/658* (2016.01)
*E01F 9/627* (2016.01)

(52) U.S. Cl.
CPC ..... *E01F 9/658* (2016.02); *E01F 9/629* (2016.02)

(58) Field of Classification Search
CPC ..... E01F 9/658; E01F 9/629; E01F 19/681
USPC ..... 404/10, 6
See application file for complete search history.

(56) References Cited

U.S. PATENT DOCUMENTS

| | | | | |
|---|---|---|---|---|
| 3,091,997 | A | 6/1963 | Byrd | |
| 4,269,534 | A | 5/1981 | Ryan | |
| 4,437,427 | A | 3/1984 | Mampaeij | |
| 5,018,902 | A * | 5/1991 | Miller | E01F 13/08 49/35 |
| 5,649,396 | A | 7/1997 | Carr | |
| 10,407,852 | B2 * | 9/2019 | Dickinson | F41H 11/08 |
| 10,570,641 | B2 * | 2/2020 | Pavey | E01F 15/0476 |
| 2002/0094235 | A1 | 7/2002 | King | |
| 2004/0175231 | A1 | 9/2004 | Reale | |
| 2010/0254760 | A1 | 10/2010 | Sung et al. | |
| 2012/0301219 | A1 * | 11/2012 | McCue | E01F 9/629 404/6 |
| 2013/0183090 | A1 * | 7/2013 | Burton | E01F 15/003 404/6 |

(Continued)

FOREIGN PATENT DOCUMENTS

| | | |
|---|---|---|
| EP | 641889 B1 | 11/1996 |
| EP | 3 216 921 B1 | 10/2018 |

OTHER PUBLICATIONS

Extended European Search Report issued in EP Application No. 23857978.3 on Sep. 4, 2025.

*Primary Examiner* — Christopher J Sebesta
*Assistant Examiner* — Kalpit Chandrakant Patel
(74) *Attorney, Agent, or Firm* — Young Basile Hanlon & MacFarlane, P.C.

(57) ABSTRACT

An apparatus includes a post having a first end and a second end, the post having a flange disposed at the first end, at least one anchor assembly, and a base assembly including an opening for receiving the first end of the post, and an anchoring region including at least one aperture for receiving the at least one anchor assembly, the base assembly having a shape that is bisectable by a line segment into a first region and a second region. The opening has a first centroid disposed in the first region and the anchoring region has a second centroid disposed in the second region.

13 Claims, 7 Drawing Sheets

(56) References Cited

U.S. PATENT DOCUMENTS

| | | | | |
|---|---|---|---|---|
| 2014/0010591 | A1* | 1/2014 | Ball | E01F 13/12 404/6 |
| 2014/0154007 | A1* | 6/2014 | Ustach | E01F 15/003 404/6 |
| 2015/0259947 | A1 | 9/2015 | McCue et al. | |
| 2017/0233962 | A1* | 8/2017 | Desideriosciolí | E01F 15/141 404/6 |
| 2020/0191222 | A1 | 6/2020 | Mesa | |

* cited by examiner

OFFSET BOLLARD

CROSS-REFERENCES TO RELATED APPLICATIONS

This application claims the benefit of U.S. Provisional Application No. 63/399,821 filed on Aug. 22, 2022. The entire contents of U.S. Provisional Application No. 63/399,821 are incorporated herein by reference.

BACKGROUND OF THE INVENTION

This invention relates to an offset impact absorbing bollard.

As electric vehicles grow in popularity, the demand for electric vehicle chargers also grows. Electric vehicle chargers are often installed upon slabs placed at the end of a parking space, where an electric vehicle uses a charging cable extending from the electric vehicle charger (similar to a gas pump for non-electric vehicles) to charge the electric vehicle. Since the electric vehicle chargers on these slabs are often positioned near parking spaces, the electric vehicle chargers face a potential risk of accidental impact from a vehicle using the parking space for charging or otherwise.

Electric vehicle chargers are often both fragile and expensive, so mitigating the risk of accidental impact from a vehicle as much as possible can be of particular importance to entities installing and/or operating such electric vehicle chargers. One approach to mitigating the risk of accidental contact between vehicles and an electric vehicle charger includes positioning the charger further away from the parking space. However, doing so increases the length of the charging cable which is expensive because the materials used to manufacture such cables are often costly.

SUMMARY OF THE INVENTION

Aspects described herein are directed to an offset bollard for installation on a slab that supports an electric vehicle charger and/or houses infrastructure (e.g., wiring) for electric vehicle charging. In general, a post of the bollard is offset from a region where the bollard is anchored to the slab. When installed, the offset configuration causes the post to be near an edge of the slab with the anchoring region of the bollard being set away from the edge of the slab. In general, the offset configuration of the post and the anchoring region achieves benefits associated with locating a post in a position near the edge of the slab while reducing risks associated with installing and positioning anchoring mechanisms in a location near the edge.

In a general aspect, an apparatus includes a post having a first end and a second end, the post having a flange disposed at the first end, at least one anchor assembly, and a base assembly including an opening for receiving the first end of the post, and an anchoring region including at least one aperture for receiving the at least one anchor assembly, the base assembly having a shape that is bisectable by a line segment into a first region and a second region. The opening has a first centroid disposed in the first region and the anchoring region has a second centroid disposed in the second region.

Aspects may have one or more of the following features.

The anchoring region may include a plurality of apertures and may be defined by an arrangement of the plurality of apertures. The base assembly may include a base cover and a dampener, and the flange of the post is disposed between the base cover and the dampener. The at least one aperture may include an opening in the base cover and a corresponding opening in the dampener and the at least one anchor assembly may extend through the at least one aperture and an opening in the flange. A portion of at least one of the base cover and the dampener may include a honeycomb structure.

The base assembly may include a resilient material. Each anchoring assembly of the at least one anchoring assembly may include a washer through which a fastener extends. The washer may include an elongated tube through which the fastener extends. A first axis may extend through the first centroid from a first end of the post to a second end of the post and a second axis may extend parallel to and offset from the first axis and through the second centroid. The post may be configured to pivot about the anchoring region.

The apparatus may further include a plastic cover configured to cover the second end of the post. The base assembly of the apparatus may have an elongated shape. The base assembly may have an oval shape. The base assembly may have a rectangular shape. The post of the apparatus may include a plurality of reinforcing ribs coupled to the flange.

In another general aspect, a bollard assembly for installation at an edge of a platform includes a post and a base coupled to the post, the base including a first region from which the post extends and a second region, offset from the first region, for anchoring the bollard assembly to the platform. The first region is configured to be installed in a first position on the platform at a first distance from the edge of the platform, and the second region is configured to be installed in a second position on the platform at a second distance, greater than the first distance, from the edge of the platform.

Aspects may have one or more of the following advantages.

Aspects advantageously allow a bollard to be installed near an edge of a slab while locating an anchoring region with anchoring mechanisms of the bollard away from the edge of the slab. In general, the slab is weaker near its edge and the process of installing anchoring mechanisms (e.g., by drilling) may damage or weaken the slab if done near the edge. Aspects thereby prevent damage to the slab due to installing the anchoring mechanisms, by installing the anchoring mechanisms further from the edge.

Aspects also advantageously mitigate the risk of dislodgement of the bollard from a slab (i.e., because of dislodgement of the slab's anchoring mechanisms). For example, when the bollard is struck by a vehicle, an anchoring region where the bollard is attached to the slab is stressed. If that anchoring region is near the relatively weaker edge of the slab, the stress on the anchoring region may cause damage to the edge of slab and possibly full or partial detachment of the bollard from the slab. In other examples, the edge of the slab itself is struck by a vehicle, which causes damage to the edge. If the bollard is anchored to the slab near the edge, the damage to the edge can cause full or partial detachment of the bollard from the slab. Aspects described herein use an offset configuration where the post of the bollard is located at the edge of the slab while the anchoring region of the bollard is offset from the edge of the slab and therefore less likely to be dislodged by impact to the bollard or edge.

Aspects advantageously mitigate the risk of damage to electric vehicle chargers positioned near an edge of a slab while also reducing the necessary length of a charging cable of the electric vehicle charger. For example, the offset bollard can be installed near the edge of the slab where it impedes the ability of a vehicle to proceed past the bollard to strike the electric vehicle charger. The close proximity of the post of the bollard to the edge of the slab permits installation of the electric vehicle charger near the edge due to the reduced risk of impact from a vehicle. Positioning an electric vehicle charger nearer to the edge reduces the required length for the electric vehicle charger's charging cable, since an electric vehicle parked abutting the edge can get closer to the electric vehicle charger to charge. Cost concerns can limit the length of the cable or incentivize reducing the length of the cable, and so the ability to safely position the electric vehicle charger near the edge can be advantageous if not necessary to account for such cost concerns.

Other features and advantages of the invention are apparent from the following description, and from the claims.

DETAILED DESCRIPTION

1 Overview

Figure 1:
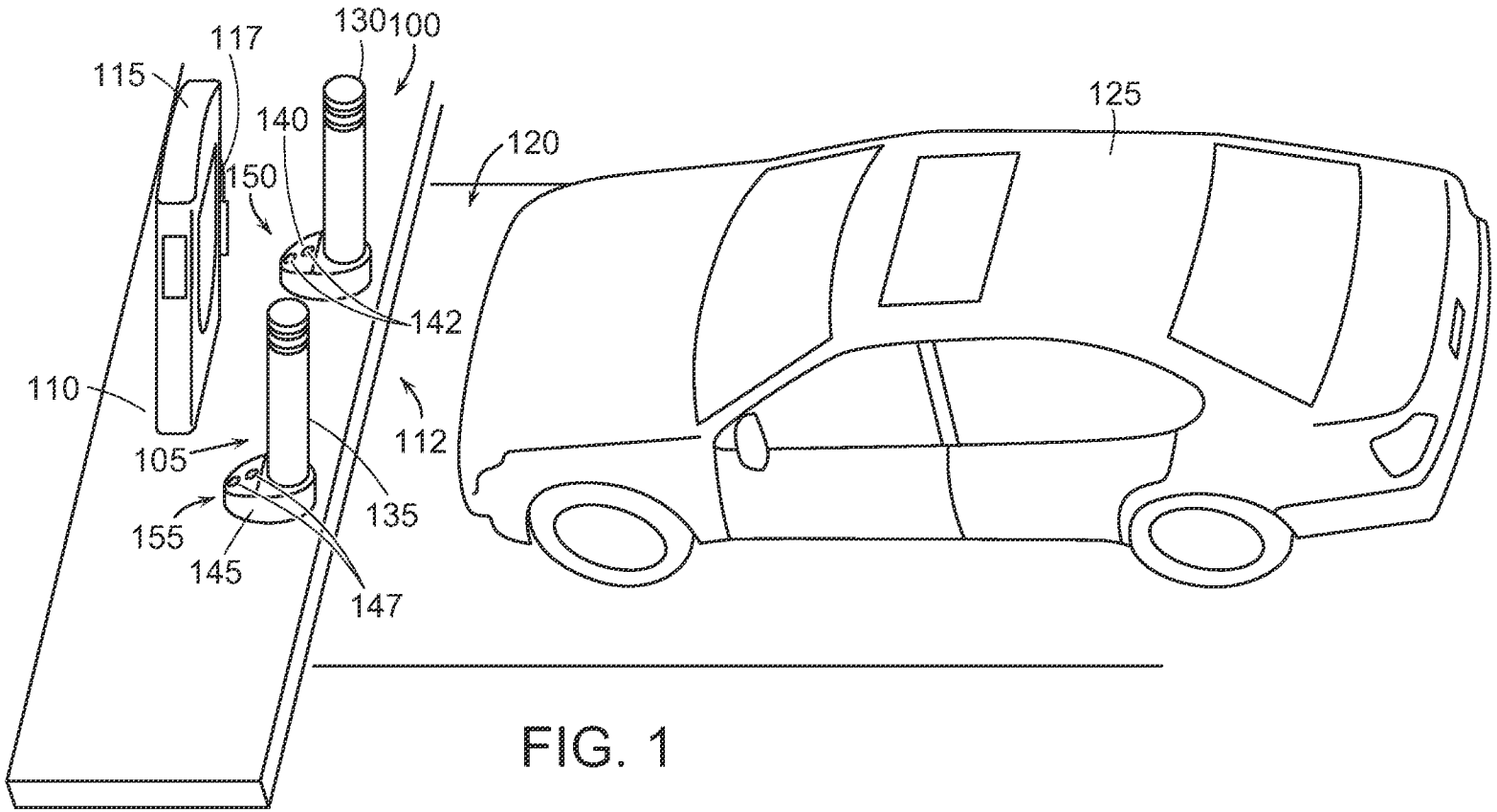
FIG. 1 is a perspective view of offset bollards installed on a slab.

Referring to FIG. 1, an electric vehicle ("EV") charger 115 is installed on a concrete slab 110 positioned at an end of a parking space 120. A vehicle 125 (e.g., an EV) is parked in parking space 120 and positioned near the concrete slab 110 and the EV charger 115 to use a charging cable 117 to charge the vehicle 125. Bollards 100, 105 are installed on the concrete slab 110, and between the parking space 120 and the EV charger 115, to mitigate risk of damage to the EV charger 115 by preventing the vehicle 125 from inadvertently driving into and damaging the EV charger 115.

In general, the bollards 100, 105 include post assemblies 130, 135 configured to be installed close to an edge 112 of the concrete slab 110, permitting the EV charger 115 to be positioned close to the parking space 120 and reducing the necessary length of the charging cable 117. The bollards 100, 105 are also configured such that anchoring regions 140, 145 of base assemblies 150, 155, including anchoring mechanisms 142, 147, are set back from edge 112. Near edge 112, the concrete slab 110 is relatively weaker and prone to damage. Locating the anchoring regions 140, 145 away from the edge 112 reduces the risk of damage to the concrete slab 110 when the anchoring mechanisms 142, 147 are installed and/or dislodgement or exposure of the anchoring mechanisms 142, 147 when the vehicle 125 makes contact with the bollards 100, 105 and/or the concrete slab 110. The offset configuration of the bollards 100, 105 benefits this exemplary EV charging context by positioning the posts 130, 135 in close proximity to the edge 112 without incurring associated risks of positioning the anchoring regions 140, 145 in similarly close proximity to the edge 112. Further, and as is described in further detail below, the bollards 100, 105 can absorb impacts and reduce damage to vehicle 125 in the case of an impact.

Figure 2:
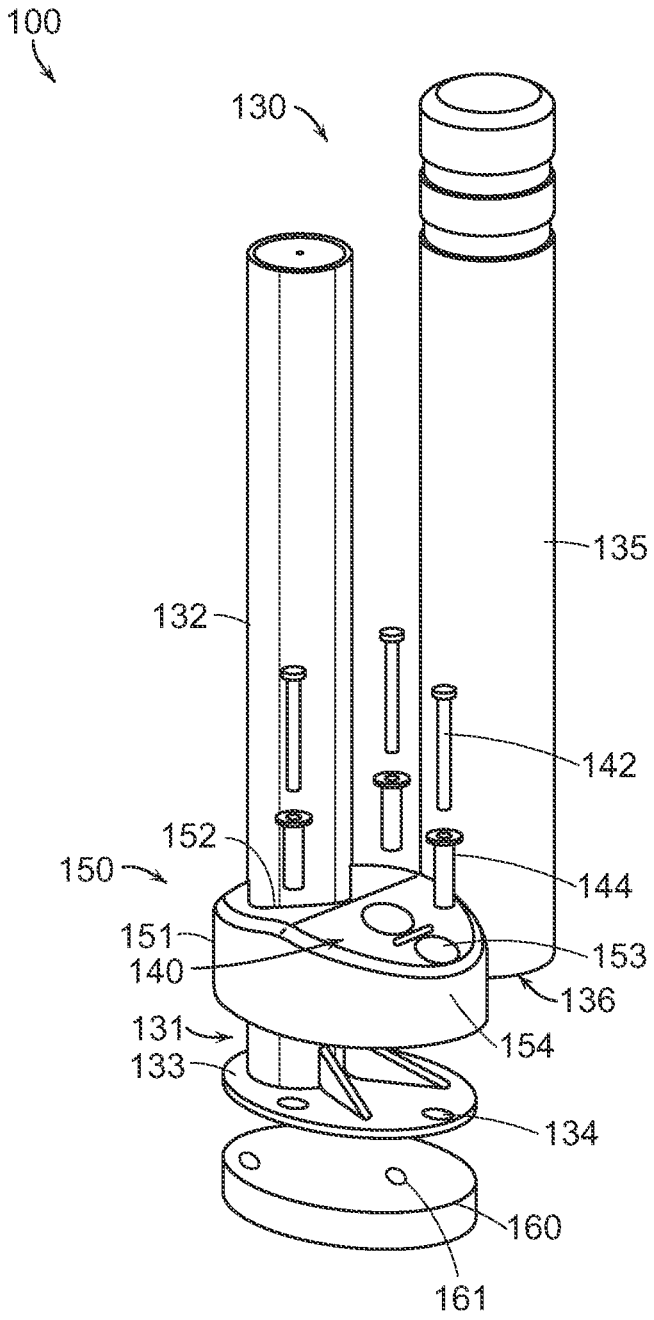
FIG. 2 is an exploded perspective view of an offset bollard.

Referring to FIG. 2, the base assembly 150 includes a base cover 151 and a dampener 160, and the post assembly 130 includes a core 131. The core 131 includes a post 132, which extends through an opening 152 of the base cover 151, and a flange 133 at an end of the post 132 closest to a surface to which the bollard 100 is anchored (e.g., the concrete slab 110 of FIG. 1). The base cover 151 covers a top surface of the flange 133, sandwiching the flange 133 between the base cover 151 and the dampener 160. In this example, edge 154 of the base cover 151 further extends toward the anchoring surface and around flange 133 and dampener 160, enclosing sides of both the flange 133 and the dampener 160. Such an enclosure can shield such interior components of the bollard 100 from, e.g., tampering, damage, and/or the weather.

In this example, the post assembly 130 further includes an outer shell 135, which includes an opening 136 through which the post 132 extends, covering a portion of the post 132 which extends past the opening 152. The outer shell 135 is a substantially tubular structure (made of, e.g., plastic) that can serve as an aesthetically pleasing, weather and abrasion-resistant cover for the bollard 100. The outer shell 135 can provide additional functions including, e.g., improving the impact-absorbing qualities of the bollard 100, reducing damage to, e.g., the vehicle 125 in case of impact, and improving visibility of the bollard 100.

Bollard 100 is attached to an anchoring surface (not shown) via the anchoring mechanisms 142, and the post assembly 130 provides a mechanism by which the bollard 100 functions as a barrier to protect the EV charger 115. However, as described above, it can be desirable both for the post 132 to be positioned close to the edge 112 and for the anchoring region 140 to be positioned back from the edge 112. As such, the bollard 100 has an offset configuration such that the anchoring region 140 is set back from the post 130 on the bollard 100 in a position substantially opposite the side of the post 130 which faces, e.g., the parking space 120 of FIG. 1. In the context of FIG. 1, this offset configuration positions the anchoring region 140 further from the edge 112 than a position of the post 130.

Returning to FIG. 2, in this example, the offset positioning includes positioning the anchoring region 140 substantially to one side of the post 130, rather than positioning the anchoring mechanisms 142, e.g., radially or otherwise symmetrically about the post 130. To accommodate this offset positioning, the base cover 151, the flange 133, and the dampener 160 all have, in this example, a substantially elliptic shape, with the post 132 positioned, rather than at the center of the elliptic shape, near one end of the elliptic shape along the elliptic shape's major axis. Conversely, the anchoring region 140 is positioned further from the end of the elliptic shape closest to the pole. Such offset positioning, and exemplary criteria defining an offset configuration, are described in further detail below, with reference to FIGS. 5A-C. Similarly, exemplary methods of defining an anchoring region are also described below, with reference to FIG. 5C.

Each of the anchoring mechanisms 142 extends through respective openings 153 of the base cover 151, respective openings 134 of the flange 133, respective openings 161 of the dampener 160, and into an anchoring surface (e.g., the concrete slab 110), fixing the base cover 151, the flange 133, and the dampener 160 both together and to the anchoring surface. Washers 144 are positioned between the anchoring mechanisms 142 and the openings 153 and interact with the base cover 151 in the region of the openings 153 to securely hold the flange 133 between the base cover 151 and the dampener 160 while preventing the heads of the anchoring mechanisms 142 from pulling through the base cover 151 in the region of the openings 153. In this example, the washers 144 have tubes extending downward (i.e., toward the anchoring surface), following the anchoring mechanisms 142, providing a sheath for the anchoring mechanisms 142. The tubes of the washers 144 limit how far the anchoring mechanisms 142 can protrude into the surface, ensuring proper tightening of the base cover 151 and dampener 160 on the flange 133.

Figure 3:
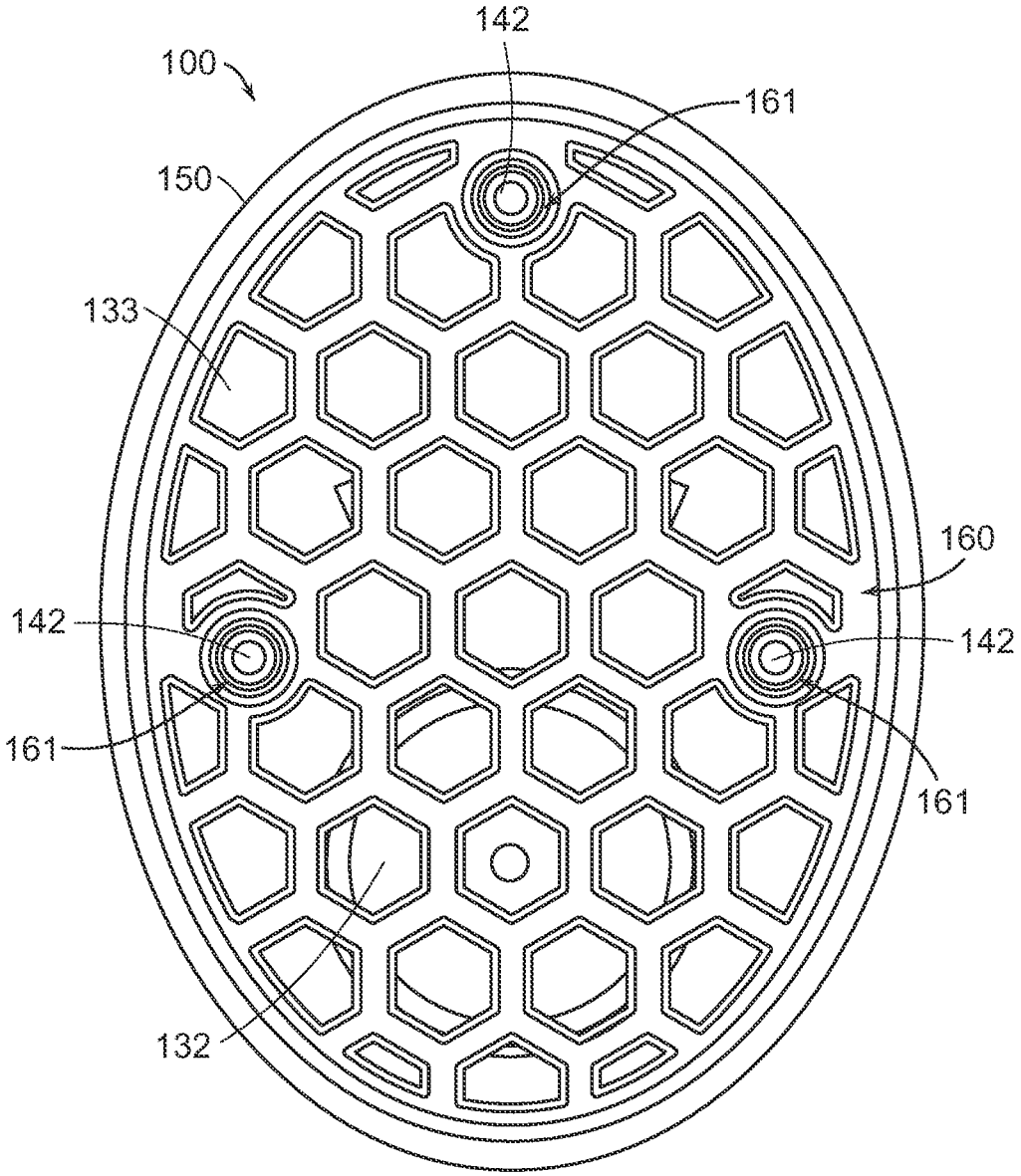
FIG. 3 is a bottom view of an offset bollard.

Referring to FIG. 3, in some examples, the dampener 160 is made of a flexible material (e.g., rubber) with a generally honeycomb design, providing the bollard 100 with capacity to flex and pivot if impacted. The dampener 160 can thereby increase the flexibility and impact-absorbing qualities of the bollard 100, allowing the bollard 100 to both better stop a vehicle (reducing risk of damage to, e.g., the EV charger 115) and reduce damage to a vehicle if said vehicle impacts the bollard 100. In further such examples, the base cover 151 is similarly made of a flexible material (e.g., rubber) and, in some such examples, with an interior honeycomb design similar to that of the dampener 160, augmenting the flexibility and impact-absorbing qualities in a similar manner as done by the dampener 160. In some examples, properties of the honeycomb design (e.g., the size of the openings and/or the thickness of the walls) can be adjusted to control impact-absorbing qualities of the bollard 100.

As described above, each of the anchoring mechanisms 142 extends through a respective opening 153 in the base cover 151 and the respective opening 134 of the flange 133. Proceeding past the flange 133, each of the anchoring mechanisms 142 extend through a respective one of the openings 161 of the dampener 160, and the openings 161, in this example, deviate from the otherwise honeycomb structure of the dampener 160. Instead of having, as in the honeycomb design of this example, a generally hexagonal shape, the openings 161 are sized to accommodate the anchoring mechanisms 142 and, in examples where the washers 144 are tubed and extend to the anchoring surface, the tubes of the washers 144. This deviation in shape of the openings 161 from the otherwise generally hexagonal honeycomb structure of the dampener 160 allows the dampener 160 to tightly surround and thereby better pivot about and absorb shock from the anchoring mechanisms 142 in the case of, e.g., an impact to the bollard 100. Conversely, the post 132, in this example, does not extend through the dampener 160, and instead rests above the dampener 160 and below (and, in this example, within) the base cover 151.

Figure 4:
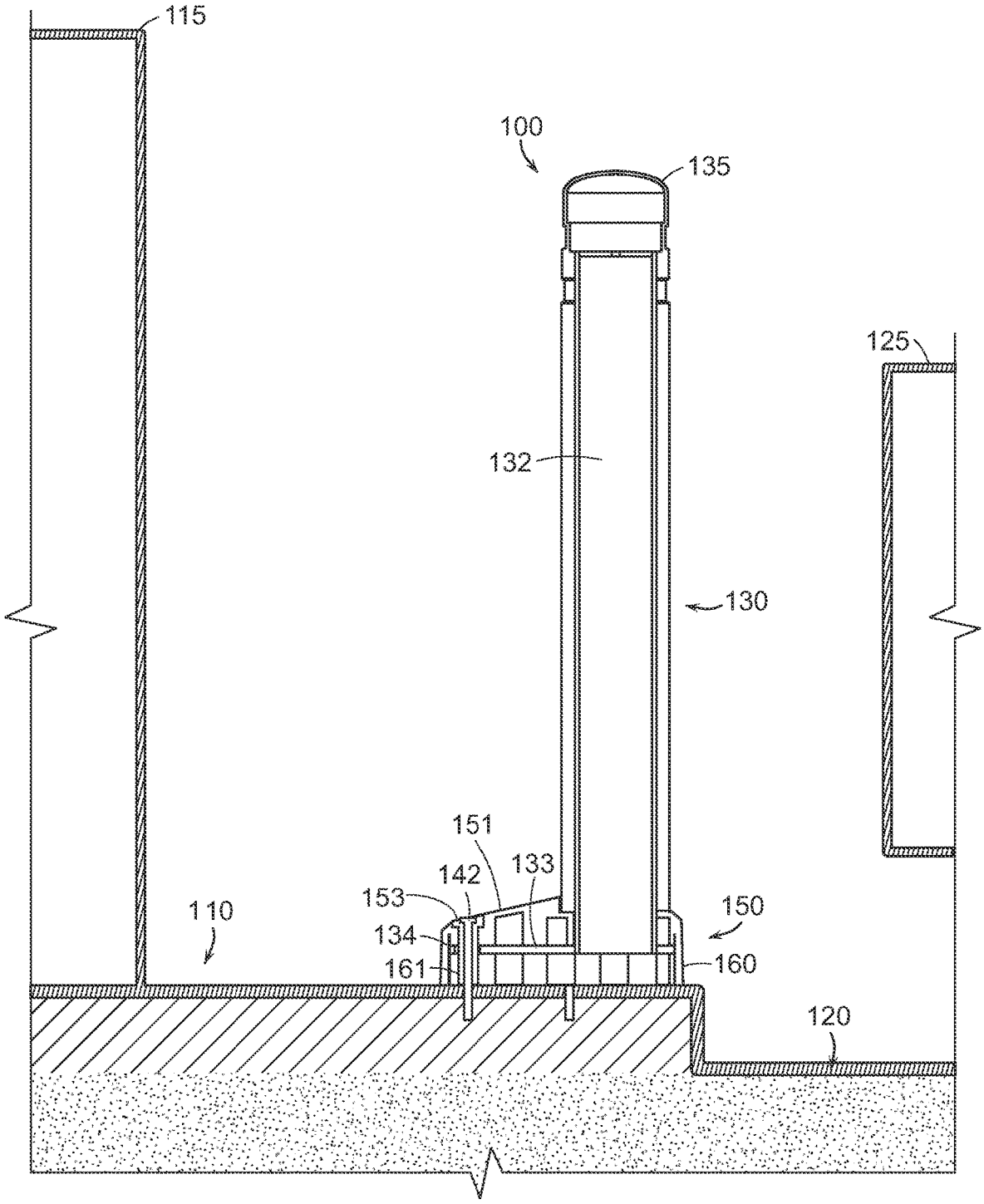
FIG. 4 is a cross-sectional view of an offset bollard.

Referring to FIG. 4, the offset configuration of the bollard 100 advantageously supports the post 130 particularly well against impacts directed substantially toward the EV charger 115 from the parking space 120. When receiving such an impact (from, e.g., the vehicle 125), the installation of the anchoring mechanisms 142 into the concrete slab 110 and the flexibility and impact-absorbing capacity of the dampener 160 and/or the base cover 151, at least in part, allow the post assembly 130 to absorb at least some of the impact by pivoting about the anchoring mechanisms 142 and transferring at least some of the shock of the impact into the base cover 151 and the dampener 160. In this way, the bollard 100 not only prevents the vehicle 125 from impacting the EV charger 115 but also absorbs at least some of the impact and/or diffuses at least some of the force of the impact into the base cover 151 and the dampener 160, potentially reducing damage to the bollard 100, the vehicle 125, and/or the slab 110.

The concrete slab 110, in some examples, is configured to accommodate the EV charger 115 by housing wiring (e.g., a bus) which connects the EV charger 115 to a power grid. Similarly, in some examples, the concrete slab 110 is configured to also accommodate the bollard 100 via, e.g., premade holes for the anchoring mechanisms 142 or an imprint for placement of the bollard 100, which may, e.g., increase the impact-absorbing qualities of the bollard 100. However, in other examples, the concrete slab 110 may be created without housing or other built-in mechanisms for accommodation of the installation of the bollard 100, and, in such examples, the bollard 100 may instead be separately installed after the concrete slab 110 has itself been installed in its resting location (in this example, abutting the parking space 120).

Figure 5A:
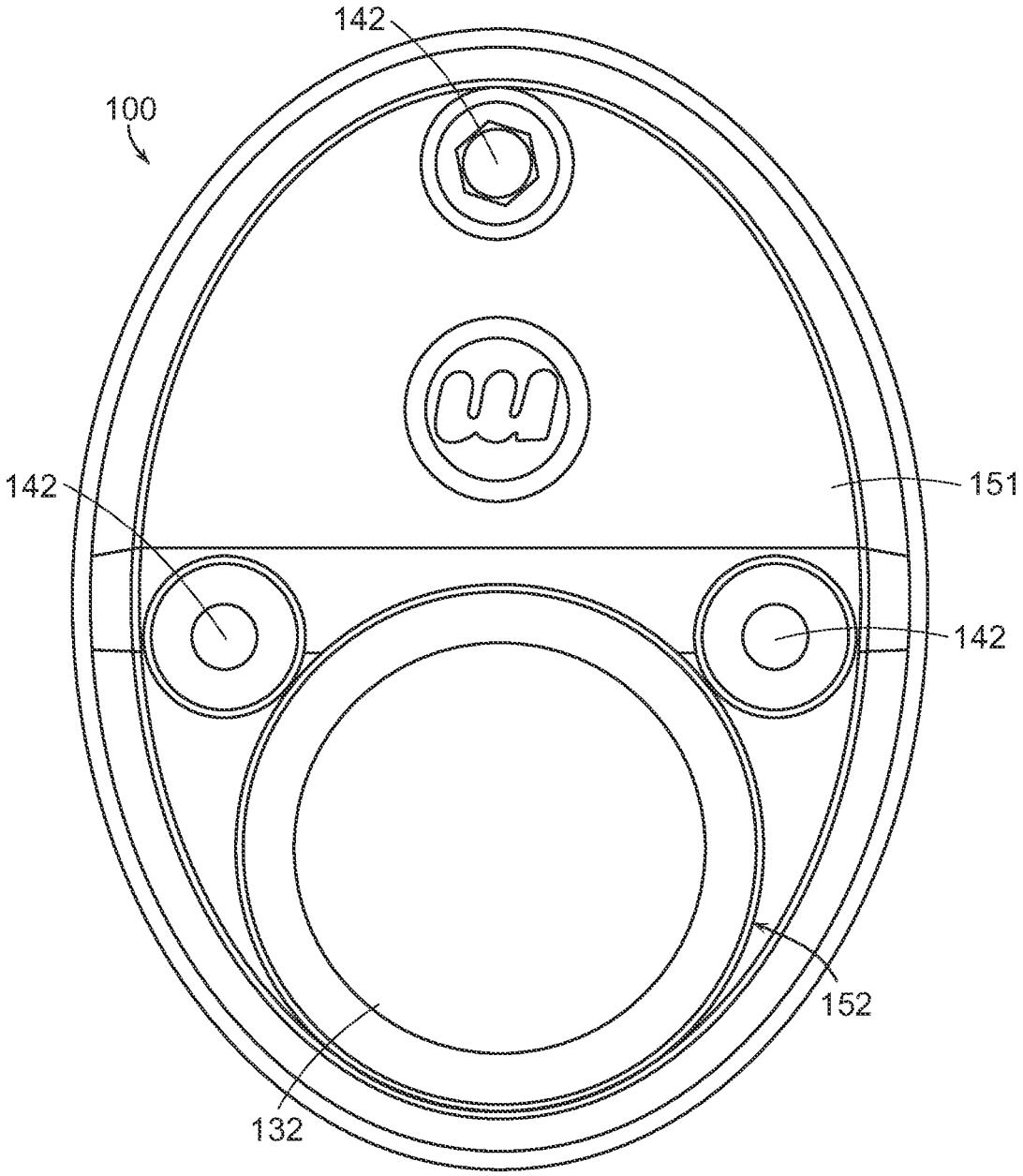
FIG. 5A is a top view of an offset bollard.

Referring to FIG. 5A, an overhead view of the bollard 100 demonstrates the offset configuration of the example embodiment of the bollard 100 of FIGS. 2-4. In this example, three anchoring mechanisms (i.e., the anchoring mechanisms 142) are used. However, in other potential examples, differing numbers of anchoring mechanisms may be used, resulting in configurations which may not identically resemble the configuration of FIG. 5A but may nonetheless be offset, as such an offset configuration is not limited to three anchoring mechanisms or to anchoring mechanisms being placed at substantially the same location on a base or on a base of a substantially similar elliptic shape. Instead, an offset configuration is defined merely by a position or positions of anchoring mechanisms, regardless of their number, and/or a position of the post(s) and/or the opening through which the post(s) extend(s), on a base of a bollard, regardless of the shape or size of the base.

Figure 5B:
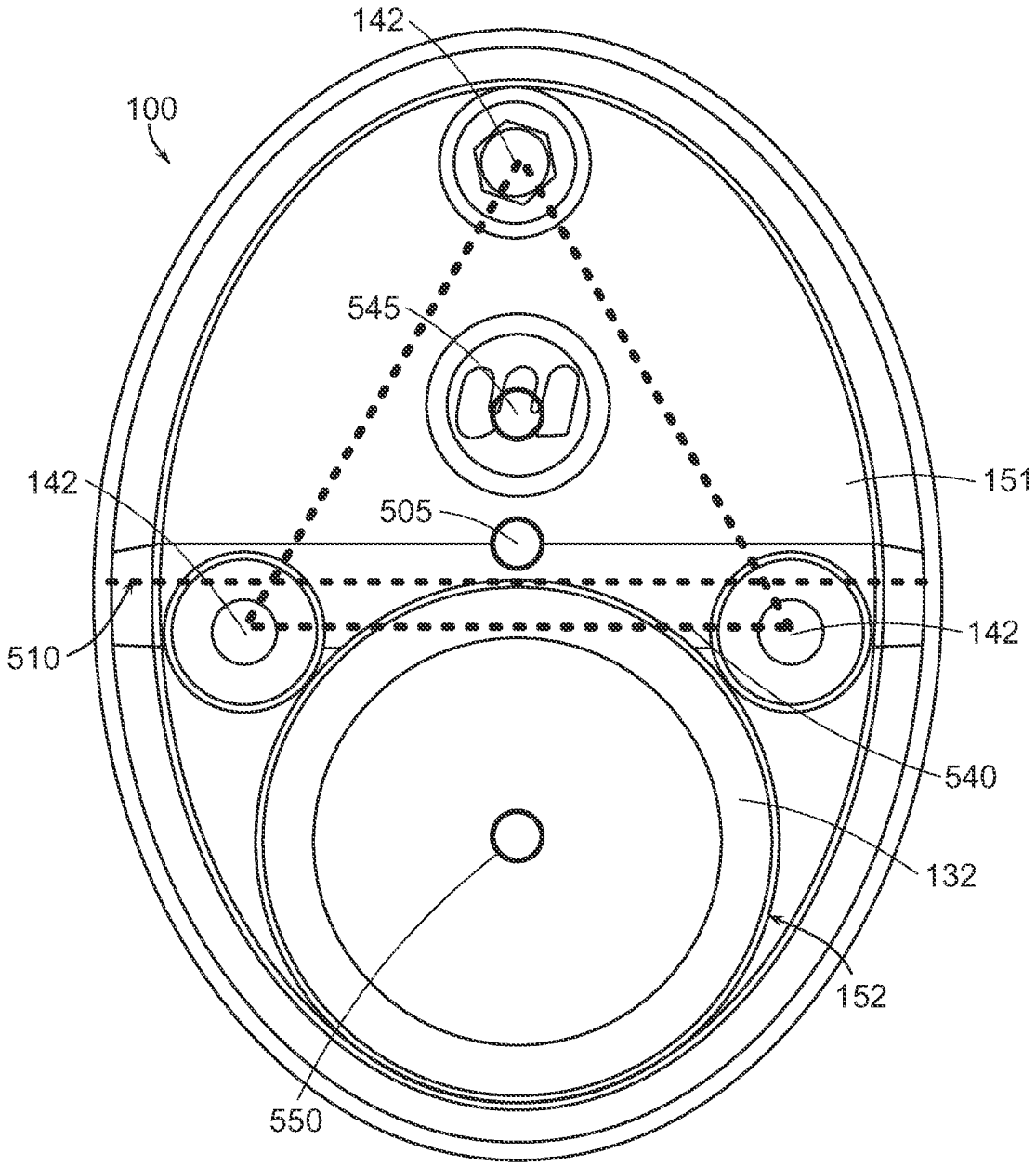
FIG. 5B is a top view of an offset bollard with annotations indicating the bollard's offset configuration.

Referring to FIG. 5B, an ellipse centroid 505 (i.e., the center point) of the elliptic shape of the base cover 151 and an opening centroid 550 is shown at the center of the opening 152 and (since the opening 152 surrounds the post 132) of the post 132. In this example, the opening centroid 550 is positioned away from the ellipse centroid 505.

The offset configuration of the bollard 100 is, in this example, defined by the existence of a line segment (such as the line segment 510) that bisects the shape of the base cover 151 and divides the area of the (in this example, elliptic) shape of the base cover 151 into two distinct regions, where the first region contains the opening centroid 550 and the second region contains the anchoring region centroid 545. Through these criteria, in this example, an "offset configuration," as described and referenced above, can be defined.

Figure 5C:
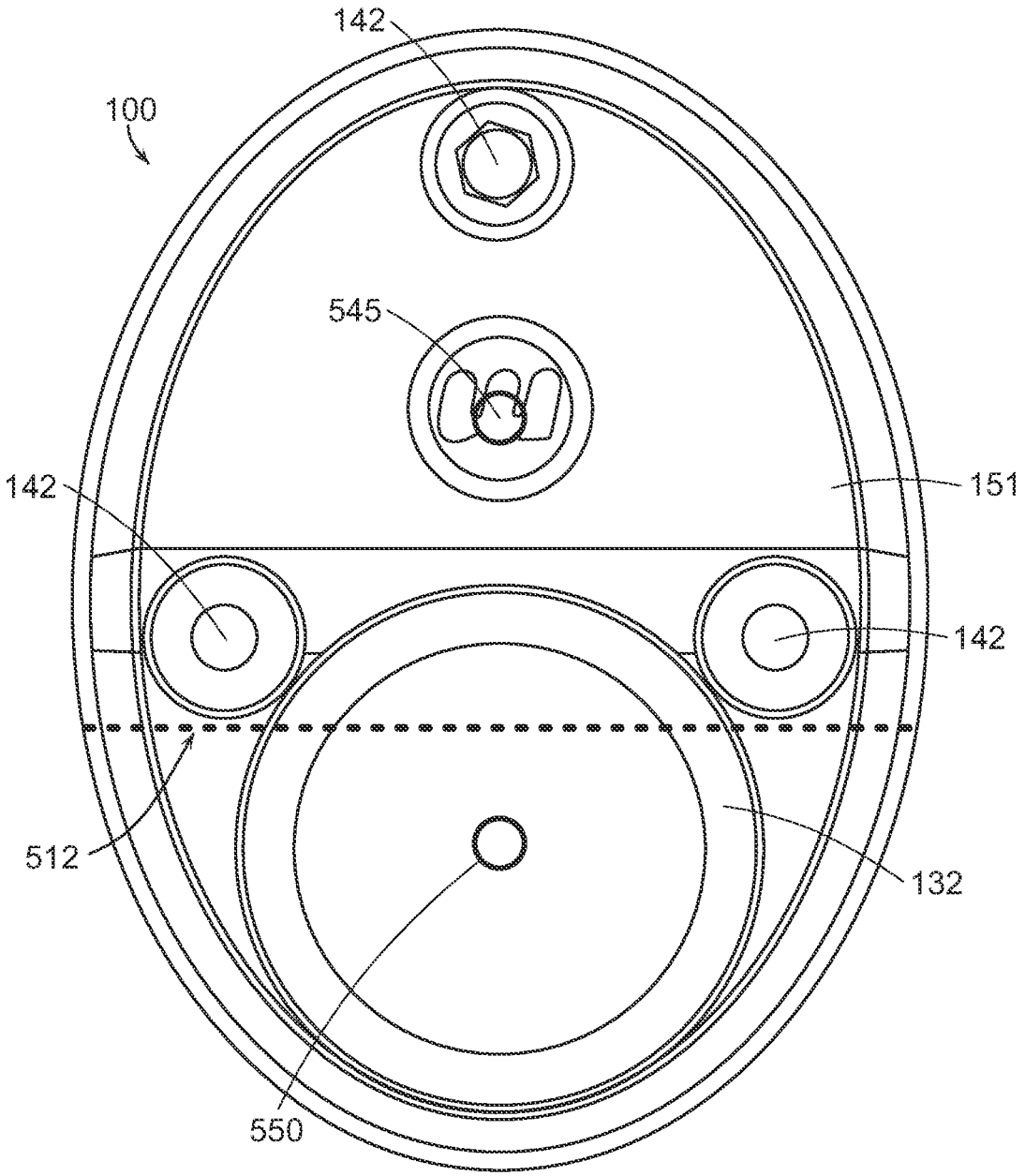
FIG. 5C is a top view of an offset bollard with annotations indicating the bollard's offset configuration.

Referring to FIG. 5C, in other examples, an offset configuration is defined by more limiting criteria. In this example, the line segment 512 satisfies a more stringent set of criteria defining an offset configuration, wherein the criteria further include, in addition to those criteria listed above with respect to the example of FIG. 5C, a requirement that the second region, as defined by the line segment 512, containing the anchoring region centroid 545 must also contain all of the anchoring mechanisms 142. Under these more stringent criteria, however, the configuration of the bollard 100 nonetheless remains an offset configuration.

Other potential configurations of a bollard not described herein (i.e., different shapes of a base of the bollard, different numbers and/or placement of a post and/or the anchoring mechanisms of the bollard) may nonetheless be offset configurations if any line segment can be defined which satisfies the exemplary criteria set out above. However, to have an offset configuration, it need not be the case that every possible line segment which bisects a shape of a base of a bollard divides the base into two such regions which satisfy the exemplary criteria above. Instead, there need only to be (at least) one single possible line segment which meets such criteria for a bollard to have an offset configuration.

2 Alternatives

In some embodiments, a bollard does not have a base cover (such as, e.g., the base cover 151 of FIGS. 2-4, and instead places a post or a flange of a post directly upon a dampener, or using some other mechanism between, on top of, or outside of the dampener, flange, and/or post. In other embodiments, a base cover may, conversely to the base cover 151 of FIGS. 2-4, not extend around a post, flange, and/or dampener. Similarly, in some embodiments, a base may not extend completely or at all toward an anchoring surface.

Some examples may not have a flange (or may have a flange of a dissimilar shape, size, or makeup to that of the flange 133 of FIGS. 2-4), and some examples may not have a dampener and may instead, e.g., position the post or the flange directly upon the anchoring surface. In examples that do include a dampener, a post and/or a flange of a post may protrude through a dampener, rather than rest above or on top of the dampener. In some embodiments, either or both of a dampener and/or a base may not have a honeycomb design and/or be made of a flexible material. In embodiments where either or both of a dampener and/or a base do have a honeycomb design, the honeycomb design may not be of a generally hexagonal shape, and may instead generally be of some other shape, such as a quadrilateral shape. Some embodiments may not cover a post with an outer shell (such as the outer shell 135 of FIG. 2) and may instead expose the post directly to the elements or cover the post with some other mechanism.

While the examples depicted herein exhibit three anchoring mechanisms, other embodiments may use any number of anchoring mechanisms, use anchoring mechanisms in different arrangements or configurations, or may use different types of anchoring mechanisms from those displayed herein. Despite having different configurations from those disclosed herein, configurations with differing numbers of, placement of, size of, and/or arrangement of anchoring mechanisms may nonetheless be offset. In some examples, when defining an anchoring region, especially in examples where the number, configuration, and/or size/type of anchoring mechanisms differs from the embodiments discussed above, the boundary of an anchoring region may not be defined by lines between centers of the anchoring mechanisms, but instead may be defined by arcs between the anchoring mechanisms, especially if the anchoring mechanisms have a generally radial symmetry.

In some examples, the base is a single piece that is configured to receive or be molded around the flange of the core of the post assembly.

In the above embodiments, the slab may have different types and shapes of edges.

As is noted in the summary section and in the originally filed claims, aspects described herein are directed to an offset bollard for installation on a slab that supports an electric vehicle charger and/or houses infrastructure (e.g., wiring) for electric vehicle charging. In general, a post of the bollard is offset from a region where the bollard is anchored to the slab. When installed, the offset configuration causes the post to be near an edge of the slab with the anchoring region of the bollard being set away from the edge of the slab. In general, the offset configuration of the post and the anchoring region achieves benefits associated with locating a post in a position near the edge of the slab while reducing risks associated with installing and positioning anchoring mechanisms in a location near the edge.

In a general aspect, an apparatus includes a post having a first end and a second end, the post having a flange disposed at the first end, at least one anchor assembly, and a base assembly including an opening for receiving the first end of the post, and an anchoring region including at least one aperture for receiving the at least one anchor assembly, the base assembly having a shape that is bisectable by a line segment into a first region and a second region. The opening has a first centroid disposed in the first region and the anchoring region has a second centroid disposed in the second region.

The anchoring region may include a plurality of apertures and may be defined by an arrangement of the plurality of apertures. The base assembly may include a base cover and a dampener, and the flange of the post is disposed between the base cover and the dampener. The at least one aperture may include an opening in the base cover and a corresponding opening in the dampener and the at least one anchor assembly may extend through the at least one aperture and an opening in the flange. A portion of at least one of the base cover and the dampener may include a honeycomb structure.

The flange of the post may be held captive between the base cover and the dampener, and a length of the washer may control a degree of compression of the washer between the base cover and the dampener.

The base assembly may include a resilient material. Each anchoring assembly of the at least one anchoring assembly may include a washer through which a fastener extends. The washer may include an elongated tube through which the fastener extends. A first axis may extend through the first centroid from a first end of the post to a second end of the post and a second axis may extend parallel to and offset from the first axis and through the second centroid. The post may be configured to pivot about the anchoring region.

The apparatus may further include a plastic cover configured to cover the second end of the post. The base assembly of the apparatus may have an elongated shape. The base assembly may have an oval shape. The base assembly may have a rectangular shape. The post of the apparatus may include a plurality of reinforcing ribs coupled to the flange.

In another general aspect, a bollard assembly for installation at an edge of a platform includes a post and a base coupled to the post, the base including a first region from which the post extends and a second region, offset from the first region, for anchoring the bollard assembly to the platform. The first region is configured to be installed in a first position on the platform at a first distance from the edge of the platform, and the second region is configured to be installed in a second position on the platform at a second distance, greater than the first distance, from the edge of the platform.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. An apparatus comprising:

a post having a first end and a second end, the post having a flange disposed at the first end;

at least one anchor assembly, and a base assembly including an opening for receiving the first end of the post, and an anchoring region including at least one aperture for receiving the at least one anchor assembly, the base assembly having a shape that is bisectable by a line segment into a first region and a second region;

wherein the opening has a first centroid disposed in the first region and the anchoring region has a second centroid disposed in the second region;

wherein the base assembly includes a base cover and a dampener, and the flange of the post is disposed between the base cover and the dampener; and wherein a portion of at least one of the base cover and the dampener includes a honeycomb structure.

2. The apparatus of claim 1 wherein the anchoring region includes a plurality of apertures and is defined by an arrangement of the plurality of apertures.

3. The apparatus of claim 1 wherein the base assembly includes a resilient material.

4. The apparatus of claim 1 wherein a first axis extends through the first centroid from a first end of the post to a second end of the post and a second axis extends parallel to and offset from the first axis and through the second centroid.

5. The apparatus of claim 1 wherein the post is configured to pivot about the anchoring region.

6. The apparatus of claim 1 further comprising a plastic cover configured to cover the second end of the post.

7. The apparatus of claim 1 wherein the base assembly has an elongated shape.

8. The apparatus of claim 7 wherein the base assembly has an oval shape.

9. The apparatus of claim 7 wherein the base assembly has a rectangular shape.

10. The apparatus of claim 1 wherein the post includes a plurality of reinforcing ribs coupled to the flange.

11. The apparatus of claim 1 wherein the at least one aperture includes an opening in the base cover and a corresponding opening in the dampener and the at least one anchor assembly extends through the at least one aperture and an opening in the flange.

12. An apparatus comprising:

a post having a first end and a second end, the post having a flange disposed at the first end;

at least one anchor assembly, and a base assembly including an opening for receiving the first end of the post, and an anchoring region including at least one aperture for receiving the at least one anchor assembly, the base assembly having a shape that is bisectable by a line segment into a first region and a second region;

wherein the opening has a first centroid disposed in the first region and the anchoring region has a second centroid disposed in the second region;

wherein the base assembly includes a base cover and a dampener, and the flange of the post is disposed between the base cover and the dampener;

wherein each anchoring assembly of the at least one anchoring assembly includes a washer through which a fastener extends; and wherein the washer includes an elongated tube through which the fastener extends.

13. The apparatus of claim 12 wherein the flange of the post is held captive between the base cover and the dampener, and a length of the washer controls a degree of compression of the washer between the base cover and the dampener.

* * * * *